US007252402B2

(12) United States Patent
Götz et al.

(10) Patent No.: US 7,252,402 B2
(45) Date of Patent: Aug. 7, 2007

(54) LIGHTING DEVICE FOR BAKING OVEN

(75) Inventors: Bernhard Götz, Zaisenhausen (DE); Walter Gramlich, Bruchsal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 6 days.

(21) Appl. No.: 10/829,753

(22) Filed: Apr. 22, 2004

(65) Prior Publication Data

US 2004/0264168 A1 Dec. 30, 2004

Related U.S. Application Data

(63) Continuation of application No. PCT/EP02/11590, filed on Oct. 16, 2002.

(30) Foreign Application Priority Data

Oct. 25, 2001 (DE) ..... 101 52 730
Feb. 5, 2002 (DE) ..... 102 04 612

(51) Int. Cl.
*F21V 33/00* (2006.01)

(52) U.S. Cl. ..... 362/89; 362/94

(58) Field of Classification Search ..... 362/89, 362/273 R, 92, 95; 126/273 R
See application file for complete search history.

(56) References Cited

U.S. PATENT DOCUMENTS 2,794,434 A * 6/1957 Evans ..... 126/200
3,823,295 A * 7/1974 Simon et al. ..... 219/748
4,410,779 A * 10/1983 Weiss ..... 219/749
4,880,955 A * 11/1989 Nitzinger et al. ..... 219/758
5,664,862 A * 9/1997 Redmond et al. ..... 362/625
6,059,420 A * 5/2000 Rogers ..... 362/92
2003/0116153 A1* 6/2003 Anschutz et al. ..... 126/273 R

FOREIGN PATENT DOCUMENTS

DE 85 18 078 U1 8/1985
DE 8518078 * 8/1985
DE 86 02 774 U1 3/1986
DE 36 43 354 A1 6/1988
DE 38 27 528 A1 8/1989
DE 3827528 * 8/1989
DE 38 08 716 A1 9/1989
DE 4212510 A1 * 10/1993
EP 0 922 910 A1 6/1999

* cited by examiner

*Primary Examiner*—Renee Luebke
*Assistant Examiner*—Evan Dzierzynski
(74) *Attorney, Agent, or Firm*—Russell W. Warnock; Craig J. Loest

(57) ABSTRACT

A lighting device for illuminating the inside of a baking oven containing an oven muffle and a front flap or door including a viewing window. The lighting device having a light beam path inside of the front flap and at least one mirror arranged in the front flap for distributing light from the lighting device light beam path into the oven muffle.

19 Claims, 3 Drawing Sheets

LIGHTING DEVICE FOR BAKING OVEN

Figure 1:
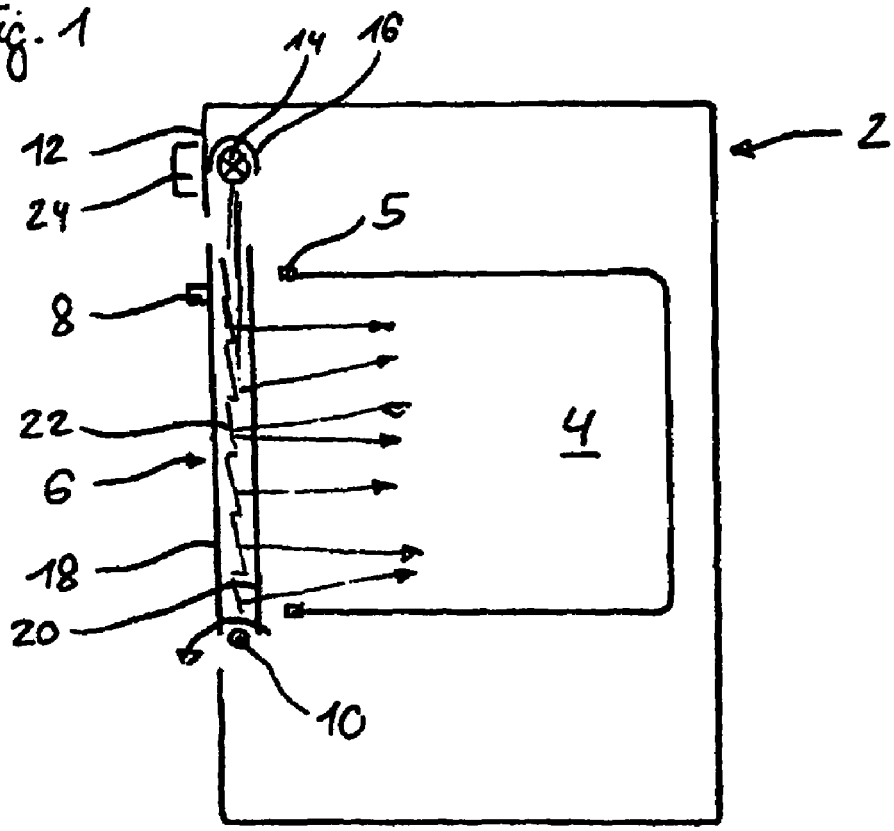

The present invention relates to a lighting device for illuminating the interior of a domestic appliance, in particular for the cooking chamber of a baking oven, according to the preamble of the independent claim.

With domestic appliances it may be necessary to light their interior. A baking oven usually has a lighting device, which allows the cooking chamber or oven muffle to be illuminated. This lighting device should be able to uniformly light a wide variety of rack levels, so that the cooking status of the food in the oven muffle can be constantly seen from the outside.

According to the prior art it is known to provide electric lamps in a fitting position behind to the right or to the left at the top, the disadvantage of which however is to illuminate the front region of the oven muffle relatively weakly. The lower rack levels are also substantially more poorly lit than the upper rack levels, located nearer to the lamp. A lamp situated centrally to one side in an alternative fitting position can illuminate the lower rack levels only very poorly. The relatively cost-effective lamp must be able to withstand very high temperatures in this fitting position, producing a negative effect on its typical shelf life.

A further alternative provides two lamps, which are in each case attached to the left and right side wall of the oven muffle. But in this example many areas are left poorly lit. In addition, the lamps may collide with a telescopic mechanism for inserting the baking trays. Such lamps, which are arranged inside the cooking chamber of the baking oven, are generally relatively expensive, as they have to withstand very high temperatures. They also offer poor access for cleaning, because they are subjected to relatively strong soiling. Providing even lighting to all rack levels is problematic.

Such a lighting device for lighting several rack levels of a baking oven with only one lamp is disclosed for example in German utility model DE 86 02 774 U1. Here a lamp is arranged in a reflector, whereof the reflection zone exhibits a curve and is made up of several successive even reflection zones, which in each case limit one another by forming an angle aligned in the same direction.

A device for lighting the baking muffle and the cooking chamber of a baking oven is also known from German disclosure document DE 38 27 528 A1. The lamp is located outside the cooking chamber in the front flap of the baking oven. Several reflectors in the oven muffle distribute the light beams. A generic lighting device for baking ovens with several rack levels is also described in German disclosure document DE 38 08 716 A1. In this case the lamp is likewise housed in the front flap of the oven, whereby the beamed light is essentially deflected into the interior of the oven muffle by means of reflectors.

The object of the present invention is to provide a simply installed lighting device for baking ovens, which enables good lighting of the baking oven interior.

The object of the independent claim 1 solves this task. Features of other developments of the invention will emerge from the dependent claims.

Accordingly, in a lighting device for lighting the interior of a domestic appliance, in particular for lighting an oven muffle of a baking oven, accessible from outside by means of a closable front flap with viewing window, a beam path runs inside the front flap. According to the present invention, in particular an inside of the front flap has several mirrors for distributing light in the oven muffle.

The advantage of this lighting device according to the present invention is even lighting of the interior of the oven muffle, without a plurality of lamps having to be placed inside the oven muffle. It is also an advantage for the front area of the oven muffle in particular to be easily visible for a user and to be well lit, without dazzling the user, by a lamp on the rear side of the oven muffle.

According to a first embodiment of the lighting device according to the present invention, when the front flap is closed, there is even distribution of light provided over several rack levels inside the oven muffle. Compared to known lighting devices, most of which are in a position to adequately light a single level of several rack levels, there is the advantage of uniform distribution of light inside the oven muffle, so that rapid assessment of the cooking progress is made possible for the user at any time.

A further embodiment of the invention provides that at least one light source is arranged above the pivoting front flap, whereof the beamed light is in the direction of the front flap, and whereof the mirror system is fed. For improved distribution of light two or more light sources are provided, which are preferably placed to the right and to the left behind a front screen of the baking oven. The particular advantage of this point of assembly is that the thermal load for the lamps is substantially less there than in the oven muffle.

Halogen lamps or the like are suitable as light sources, for example. Also possible and advantageous is the use of gas discharge lamps, known as so-called fluorescent lamps. Exchanging a defective lamp is substantially facilitated at such an ergonomically favourable point of assembly, as compared to a conventional light source in the oven muffle, since accessibility from outside is considerably improved. The lamp exchanges can be made without difficulty, and without having to be handled on the reverse of the oven muffle.

A preferred embodiment of the lighting device according to the present invention provides that curved mirrors are fitted on the inside of the front flap. Preferably, the curved mirrors arranged further from the light source, that is, for example arranged underneath, have larger effective mirror surfaces than the higher mirrors. In this way, light can be distributed extensively uniformly over several rack levels and also in the central direction to the oven muffle.

The mirrors are arranged according to a preferred further embodiment between an at least partially transparent outer pane and an at least partially transparent inner pane of the front flap. The mirror can preferably be provided to the left and to the right of a viewing window arranged centrally in the front flap, whereby these regions are in each case lacquered or painted, or are fitted with a screen or the like, so that the mirrors are not visible from outside. The mirrors are preferably located in a sealed cavity between inner and outer pane, which is compartmentalised against incoming damp, moisture and vapour. In this way, the uniformly fine reflection capability of the mirrors can be guaranteed, since no reflection-damping coatings can condense on the mirror surfaces.

The mirror hidden at the front behind side front glass cover can also be partially covered from the inside, so that in each case only one light-emitting surface is configured to be transparent. In this case the inner glass must be fitted with a series of transparent through-holes in the otherwise non-transparent side region. This light-emitting surface is particularly cleaning-friendly compared to a lamp arranged in the cooking chamber.

A further embodiment according to the present invention provides a switch, which switches off the light sources when the front flap is open. This switch can be designed as a mechanical pressure switch in a front frame of the oven muffle, which releases a contact when the front flap is open, which breaks the lamp power circuit. The switch can also be designed contact-free, for example as a so-called reed switch, in which a nearby magnet causes it to close. Thus, a small magnet can be provided on the inside of the front flap, which lies near the reed switch in the front frame of the oven muffle when the front flap is closed. With the front flap slightly open the magnet is moved away from the switch, allowing the latter to open the lamp power circuit. This type of contact-free switch can guarantee smooth function over a long period, since it is not subject to wear and tear and is virtually insensitive to external influences such as pollution.

The mirrors or curved mirrors can be produced advantageously from reflective metal, for example stainless steel or sheet aluminium. This material is easy to form and already has a high degree of reflection in the raw state. Machined surfaces, which are smoothed for example by means of polishing or additional coating, can be improved further in their reflection quality. Such coating can for example comprise chroming. An added advantage of such materials is that heat reflection from the baking pipe can return to the latter, bringing a reduction in surface temperature of the oven as well as a reduction in its energy consumption.

The lighting device according to the present invention can be provided in place of conventional lighting in the interior of the oven muffle. An already available lamp can complement the lighting device with the door-side mirror system, to bring a clear improvement in lighting the oven muffle with relatively weak additional lamps. Alternatively, the baking oven lamp is switched on when the door is opened, while the door lighting is switched off. This ensures that an operator is presented with a lit cooking chamber also when the door is opened. The baking oven lighting is switched off when the baking oven door is closed, if the door lighting is adequate.

In summary, the following are examples of advantages of the lighting device according to the present invention. The additional or sole lighting by means of light sources behind a front screen is not subject to any contamination, for example by spattering from the grille. The lamps are clearly subject to lower operating temperatures, adding to their service life. In addition, simpler commercially available lamps can be used instead of the relatively expensive heat-resistant lamps for conventional oven muffle lighting. According to a preferred embodiment at least one LED array can serve as a light source. This ensures lower energy consumption and lower intrinsic heating. Additionally, LEDs are extremely reliable and are available in different colours. When an orange colour is mixed in with the LED array, the colour impression of the cooked goods is particularly realistic. Also, the cooking chamber can be adjusted by the operator and/or is lit in different colours depending on the cooking process in progress or the operating status of the cooked goods.

Since the lamp is relatively easily accessed from the front, it can be easily exchanged when necessary. And because there are no electrical components such as cables, lamps, switches or the like in the front flap, there are reduced costs and increased operating safety, since such mobile parts are generally subject to increased wear. There are also no separate service openings required for an exchange of lamps in the door, which would have to be sealed off from penetration by pollution, moisture (e.g. when the front flap is cleaned) and vapours by means of expensive seals.

The lighting device according to the present invention causes clearly improved and even lighting of the interior of the oven muffle. In addition, the lighting is beamed in the direction of viewing and thus does not dazzle the observer. In this way all rack levels can be illuminated uniformly.

The surface temperatures and energy consumption are likewise reduced on account of the possibility of reflection of heat radiation from the baking pipe.

Further advantages and preferred embodiments can be inferred from the description of the figures.

Figure 2:
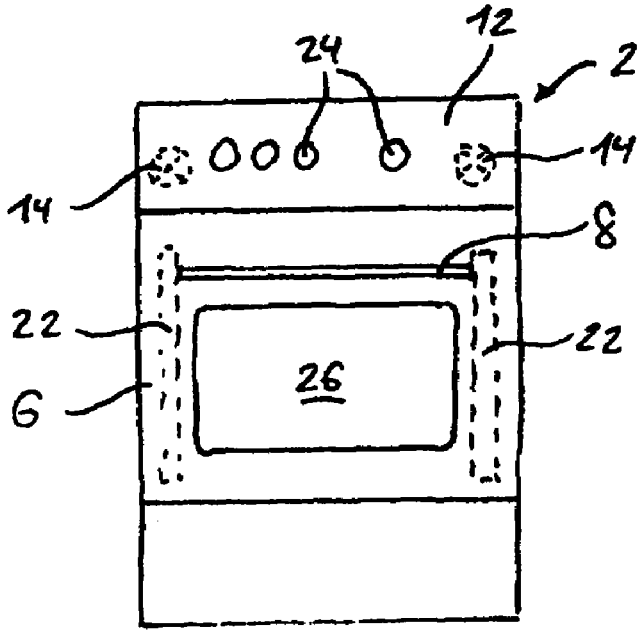
Figure 3:
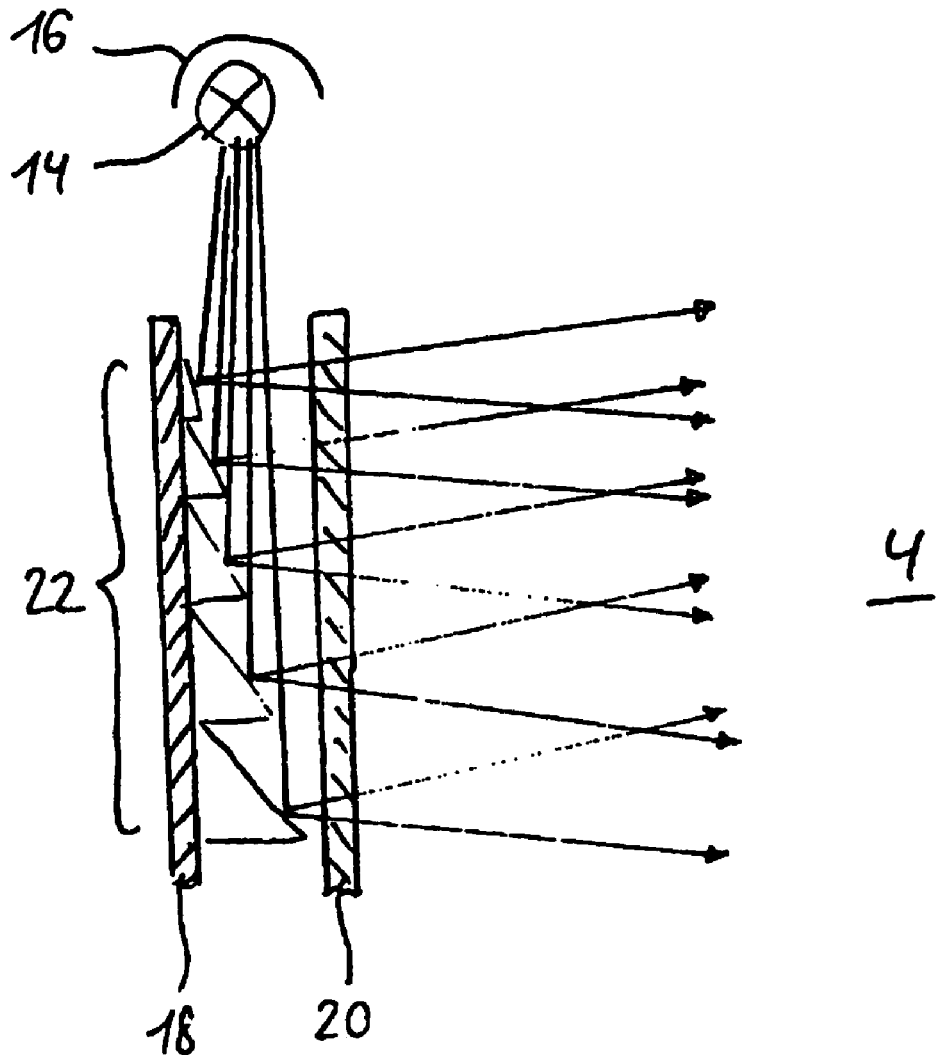
Figure 4:
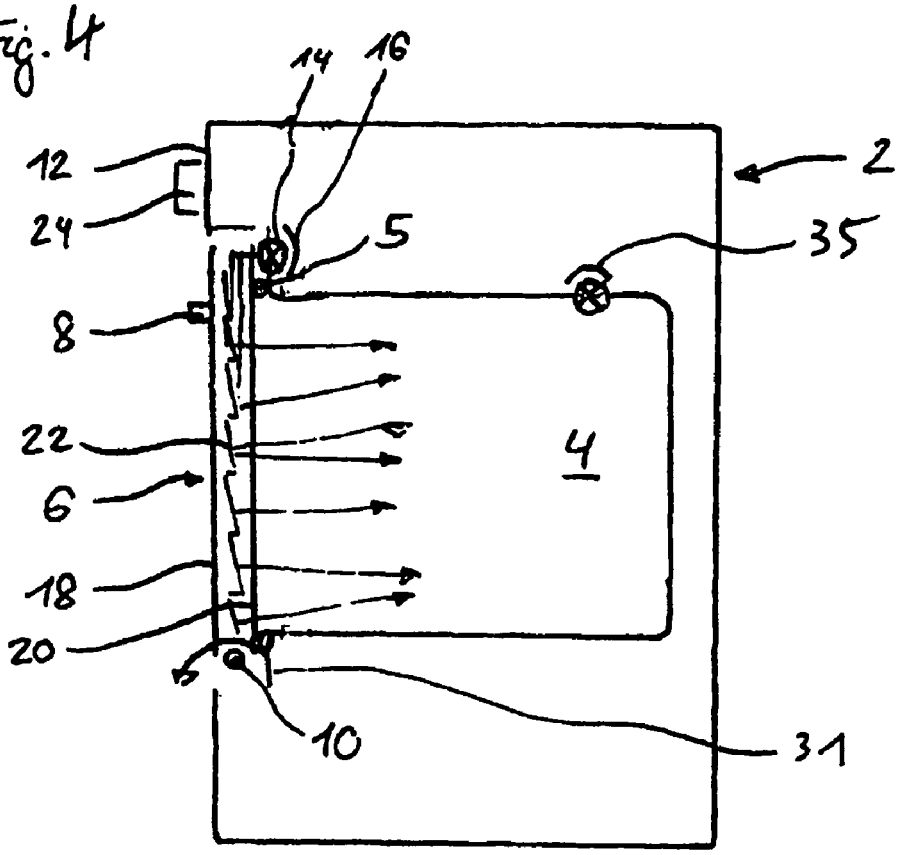
Figure 5:
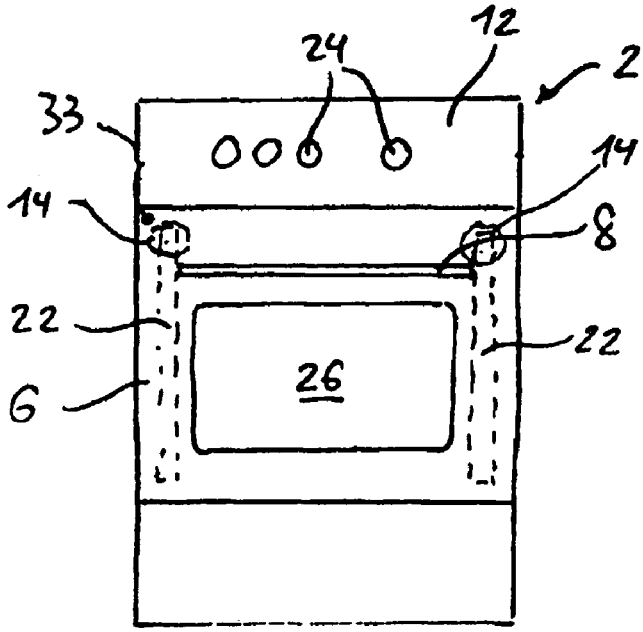

The invention will now be explained hereinbelow by means of two embodiments, where:

FIG. 1 shows a baking oven with an inventive lighting device in schematic side elevation according to the first embodiment, FIG. 2 shows the baking oven according to FIG. 1 in a schematic frontal elevation, FIG. 3 shows a section of a front flap of the baking oven according to FIGS. 1 and 2, FIG. 4 shows a baking oven in a representation according to FIG. 1 as per the second embodiment, and FIG. 5 shows the baking oven according to FIG. 4 in a schematic frontal elevation.

FIG. 1 shows a baking oven 2 with a lighting device according to the present invention in schematic side elevation. The baking oven 2 has an essentially square oven muffle 4, accessible from outside via a front flap 6. The front flap 6 can usually be swung by means of a handle 8 about a low pivot axis 10 into a horizontal open position. In the closed state the inner side of the front flap 6 rests on a front frame 5 of the oven muffle 4, usually lying on a heat-resistant circular seal. During operation the oven muffle 4 is heated electrically or with gas and is heated up to temperatures of more than 200° C., depending on requirements.

The front flap 6 comprises an at least partially transparent outer pane 18 as well as an at least partially transparent inner pane 20, attached at a distance form one another on a frame of the front flap 6. The outer pane 18 and the inner pane 20 preferably comprise heat-resistant mineral glass. It can likewise comprise other heat-resistant transparent materials. Provided behind a front screen 12 of the baking oven 2, on which knobs 24, display lights and/or instruments and the like are arranged, is at least one light source 14, having a reflector 16, which ensures that light beamed by the light source 14 is deflected exclusively downwards towards the front flap 6.

Also arranged between outer 18 and inner pane 20 is at least one mirror system 22, by which the light beamed by the light source 14 towards the oven muffle 4 is deflected. For this purpose a window on an upwards-pointing front side of the front flap 6 is required, through which the light can filter and strike the mirror system 22. The mirror system 22 is preferably arranged in an airtight and watertight chamber, formed by outer 18 and inner pane 20. In this way no pollution, moisture, vapour, etc. can condense on the mirror system and impair its reflective properties.

FIG. 2 shows a baking oven 2 according to FIG. 1 in schematic frontal elevation. In particular, a viewing window 26, framed by non-transparent areas and located in the front flap 6, is evident here. Two light sources 14, one to the left and one to the right, behind the front screen 12 send their light beams substantially vertically downwards in the direction of a mirror systems 22, in each case arranged under each light source 14 behind the outer pane 18 of the front flap 6. Each of these mirror systems 22 consists of a number of subjacent curved mirrors (cf. FIG. 3), which distribute the light evenly inside the oven muffle 4.

On the front flap is preferably a switch, which effectively switches off the light sources 14 when the front flap 6 is open. This can be for example a reed switch, operated by a magnet located to one side of the front flap.

The light sources 14 can be designed for example as halogen or gas discharge lamps, characterised in each case by relatively favourable energy consumption. The requirements for heat resistance of the light sources 14 are not overly high, because they are situated outside the oven muffle 4, differently to conventional lighting devices for baking ovens.

FIG. 3 shows a section of a front flap 6 of the baking oven 2. The mirror system 22, whereof one or two can be provided in the front flap 6, comprises a number of subjacent curved mirrors, which deflect the impinging light substantially laterally (from the direction of the drawing plane) and to a lesser extent upwards and downwards. In this way, several rack levels in the oven muffle 6 can be uniformly lit, also is several baking trays are pushed in.

The curved mirrors of the mirror systems 22 can preferably comprise sheet metal, which has the smoothest possible surface for the purpose of the best possible reflection capability. The sheet can be polished or chromed, for example. For the mirror systems however heat-resistant synthetic material is also suitable, which is chromed galvanically. Such a mirror system made of synthetic material can be made particularly simply and cost-effectively via injection moulding.

In the outer regions surrounding the viewing window 26 the outer pane 18 is preferably not transparent, such that the mirror systems 22 are not visible from outside. The inner pane 20 can be fully transparent. To avoid unwanted reflections the inner pane can be designed only partially transparent in the outer regions surrounding the viewing window 26, whereby in addition only the points where light is meant to enter through the inner pane 20 into the oven muffle are designed transparent. Likewise, the frontal window, which provides a tight connection of the chamber formed between outer 18 and inner pane 20, can be designed transparent only at those points where the light sources 14 or their surrounding reflectors 16 send their light down into the front flap 6.

The specialist will recognise that the invention is not limited to the illustrated embodiment, but that a plurality of variants and modifications thereof is included.

According to FIG. 4 the baking oven 2 has a frame-like muffle flange 31 enclosing the cooking chamber opening and known per se. At the front is the frame-like baking oven seal 5 is attached on this muffle flange 31, which seals off the cooking chamber to the outside when the door is closed. In each case a light source 14 is arranged above and thus outside the sealing area created by the seal 5 in the upper edge region of the muffle flange 31. This arrangement protects the light source well from pollution from the cooking chamber. At the front the light source 14 illuminates in an opposite optic window of the door when the door is closed. The light radiation is first reflected downwards and then, according to the first embodiment, reflected via the mirror system 22 back into the cooking chamber 4 to light it. Also, on the front of the muffle flange 31 at least one switch 33 is arranged, connected to the lighting device 14. When the door 6 is opened the switch 33 switches off the lighting device 14, preventing the operator from being dazzled. At the same time also the switch 33 switches on an additional baking oven light 35 arranged in the cooking chamber. This ensures that an operator is presented with an adequately lit cooking chamber on opening the door 6. Such a baking oven light can also be provided in the baking oven according to the first embodiment.

The invention claimed is:

1. A lighting device for illuminating the interior of a baking oven, comprising:

an oven muffle in the baking oven;

said oven muffle accessible from the outside of said baking oven by a front flap;

said front flap including a viewing window;

the lighting device including a light beam path inside of said front flap; and at least one mirror arranged in said front flap for distributing light from said e light beam path into said oven muffle, said at least one light source arranged above said front flap, said at least one light source for emitting, along said light beam path inside of said front flap, a light beam that is intercepted by said mirror to be distributed by said mirror into said oven muffle.

2. The lighting device according to claim 1, including said oven muffle having a plurality of rack levels inside of said oven muffle and said mirror designed to uniformly distribute light over said plurality of rack levels when said front flap is closed.

3. The lighting device according to claim 1, including a plurality of mirrors arranged vertically in the interior of said front flap and each mirror placed further down of another have a larger effective mirror surface.

4. The lighting device according to claim 1, including said front flap having an at least partially transparent outer pane and an at least partially transparent inner pane and a plurality of mirrors are arranged between said inner and outer panes.

5. The lighting device according to claim 4, including said plurality of mirrors are not visible outside said oven when said front flap is closed.

6. The lighting device according to claim 1, including a control unit, which switches off said light source when said front flap is opened and said control unit is a selected one of a control unit formed by a reed switch and a control unit not formed by a reed switch.

7. The lighting device according to claim 1, including a baking oven flange and including at least one light source arranged at the front of said flange.

8. The lighting device according to claim 7, including a sealing area provided between said flange and said front flap and said light source arranged outside said sealing area.

9. The lighting device according to claim 1, including a baking oven light source arranged in the interior of said oven to illuminate said muffle when said front flap is opened.

10. The lighting device according to claim 9, including a control unit, which switches on said oven light source when said front flap is opened.

11. The lighting device according to claim 1, including at least one light source arranged outside said front flap, which light source beams light into said front flap.

12. A cooking appliance, comprising:

a lighting device for illuminating the interior of the cooking appliance;

an oven muffle in said cooking appliance;

said oven muffle accessible from the outside of said cooking appliance by a front flap;

said front flap including a viewing window;

the lighting device including a light beam path inside of said front flap;

at least one mirror arranged in said front flap for distributing light from said lighting device light beam path into said oven muffle; and including a plurality of mirrors arranged vertically in the interior of said front flap and each mirror placed further down of another have a larger effective mirror surface.

13. The cooking appliance according to claim 12, including said oven muffle having a plurality of rack levels inside of said oven muffle and said mirror designed to uniformly distribute light over said plurality of rack levels when said front flap is closed.

14. The cooking appliance according to claim 12, including a baking oven flange and including at least one light source arranged at the front of said flange.

15. The cooking appliance according to claim 12, including a baking oven light source arranged in the interior of said cooking appliance to illuminate said muffle when said front flap is opened.

16. The cooking appliance according to claim 15, including a control unit, which switches on said oven light source when said front flap is opened.

17. The cooking appliance according to claim 12, including at least one light source arranged outside said front flap, which light source beams light into said front flap.

18. A cooking appliance, comprising:

a housing and an oven muffle disposed within the housing;

a front flap mounted for movement with respect to the housing to provide access to the oven muffle;

a lighting device supported by the housing and being fixed with respect to the housing and including a light beam path inside the front flap; and at least one mirror arranged in the front flap for distributing light from said lighting device light beam path into the oven muffle.

19. The cooking appliance according to claim 18, wherein the at least one mirror includes a plurality of mirrors arranged vertically in the interior of said front flap and each mirror placed further down of another have a larger effective mirror surface.

* * * * *